US009978544B2

(12) United States Patent
Koike et al.

(10) Patent No.: US 9,978,544 B2
(45) Date of Patent: May 22, 2018

(54) KEYBOARD APPARATUS AND UPPER COVER FOR KEYBOARD

(71) Applicant: FUJITSU COMPONENT LIMITED, Tokyo (JP)

(72) Inventors: Tamotsu Koike, Tokyo (JP); Akihiko Takemae, Tokyo (JP); Satoshi Takeda, Yokohama (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days. days.

(21) Appl. No.: 15/000,140

(22) Filed: Jan. 19, 2016

(65) Prior Publication Data

US 2016/0225554 A1 Aug. 4, 2016

(30) Foreign Application Priority Data

Jan. 30, 2015 (JP) ..... 2015-017585

(51) Int. Cl.
*H01H 13/7065* (2006.01)
*H01H 3/12* (2006.01)

(52) U.S. Cl.
CPC ..... *H01H 13/7065* (2013.01); *H01H 3/125* (2013.01)

(58) Field of Classification Search
CPC ..... H01H 13/7065; H01H 3/125
USPC ..... 200/5 A
See application file for complete search history.

(56) References Cited

U.S. PATENT DOCUMENTS

2007/0146976 A1 6/2007 Lin
2010/0232861 A1 9/2010 Shibata et al.
2011/0089792 A1* 4/2011 Casebolt ..... B29C 45/14311 312/223.2
2011/0155551 A1* 6/2011 Yamada ..... H01H 3/125 200/5 A
2012/0199458 A1* 8/2012 Takemae ..... H01H 13/14 200/5 A
2013/0134022 A1* 5/2013 Liang ..... H01H 13/705 200/5 A
2015/0021152 A1* 1/2015 Koike ..... H01H 13/86 200/5 A

FOREIGN PATENT DOCUMENTS

JP 2000-172411 6/2000
JP 2011-187298 9/2011
TW I296810 5/2008

* cited by examiner

*Primary Examiner* — Edwin A. Leon
*Assistant Examiner* — Iman Malakooti
(74) *Attorney, Agent, or Firm* — IPUSA, PLLC

(57) ABSTRACT

A keyboard apparatus of an electronic apparatus includes a key-switch structure including a membrane switch having contact points, keycaps for operating the contact points of the membrane switch, and actuators configured to urge the keycaps upwardly upon the keycaps being pressed down, and an upper cover configured to be part of a housing of the electronic apparatus and having a mount part, the mount part supporting the key-switch structure that is placed on an upper surface of the mount part, wherein the mount part is formed integrally with the upper cover.

6 Claims, 7 Drawing Sheets

KEYBOARD APPARATUS AND UPPER COVER FOR KEYBOARD

BACKGROUND OF THE INVENTION

1. Field of the Invention

The disclosures herein relate to a keyboard apparatus and a keyboard panel.

2. Description of the Related Art

A keyboard apparatus is widely used as an inputting unit of an electronic apparatus such as a personal computer.

A keyboard apparatus has membrane switches, rubber domes, and keycaps stacked one over another on the top of a metal support panel (i.e., reinforcement plate), which is situated under the upper cover of a personal computer. The upper cover has a keycap opening through which the keycaps are exposed. The keycaps project upward from the upper cover through the keycap opening, thereby allowing the keys to be pressed down.

A keyboard apparatus having a support panel utilizes the support panel to withstand a pressing force even when an operator applies strong pressure on the keycaps. This configuration enables the provision of satisfactory key feeling.

With the need for a metal support panel in addition to an upper cover, a keyboard apparatus with such a support panel tends to be heavy. It may be conceivable to use a thin support panel or provide holes through the support panel for the purpose of weight reduction, however, such a support panel ends up having a lowered structural strength. However, applying a strong force to the keycaps during keying operations may result in the support panel being deformed, which undermines the satisfactory key feeling.

Among other objectives, one objective of the disclosures herein may be to provide a keyboard apparatus and a keyboard panel that enable weight reduction without losing satisfactory key feeling.

[Patent Document 1] Japanese Laid-open Patent Publication No. 2000-172411

SUMMARY OF THE INVENTION

It is a general object of the present invention to provide a keyboard apparatus that substantially obviates one or more problems caused by the limitations and disadvantages of the related art.

According to an embodiment, a keyboard apparatus of an electronic apparatus includes a key-switch structure including a membrane switch having contact points, keycaps for operating the contact points of the membrane switch, and actuators configured to urge the keycaps upwardly upon the keycaps being pressed down, and an upper cover configured to be part of a housing of the electronic apparatus and having a mount part, the mount part supporting the key-switch structure that is placed on an upper surface of the mount part, wherein the mount part is formed integrally with the upper cover.

According to an embodiment, an upper cover for a keyboard includes a mount part configured to support, on an upper surface thereof, a membrane switch having contact points, keycaps for operating the contact points, and actuators configured to urge the keycaps upwardly, wherein the mount part is formed integrally with the upper cover.

According to at least one embodiment, weight reduction is achieved without losing satisfactory key feeling.

Other objects and further features of the present invention will be apparent from the following detailed description when read in conjunction with the accompanying drawings.

DESCRIPTION OF THE PREFERRED EMBODIMENTS

Figure 1:
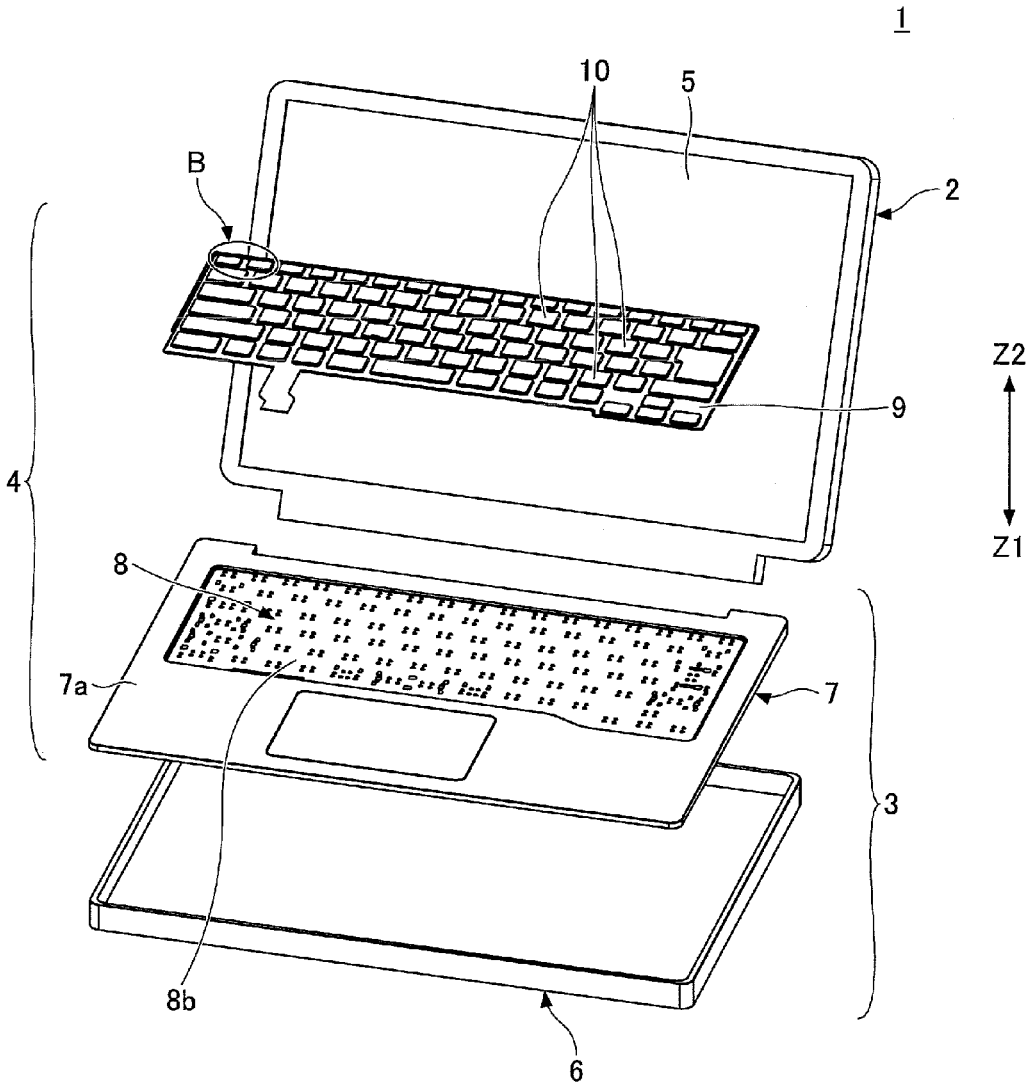
FIG. 1 is an exploded view of a notebook personal computer having a keyboard apparatus according to an embodiment.

In the following, various non-limiting embodiments of the present invention will be described with reference to the accompanying drawings.

In illustrations provided in the drawings, the same or corresponding members or elements are referred to by the same or corresponding numerals, and duplicate descriptions thereof will be omitted. Further, the drawings are not provided for the purpose of illustrating size ratios between members or elements unless otherwise specified. Specific sizes may be determined by those skilled in the art by referring to the non-limiting embodiments that will be described hereinafter.

Further, the embodiments that will be described hereinafter are examples only that do not limit the invention. Features and combinations thereof described in these embodiments may not necessarily be essential to the invention.

In the following description, the direction (i.e., Z1 direction) in which keycaps 10 are pressed may sometimes be referred to as a downward direction, and the direction (i.e., Z2 direction) in which the keycaps 10 return due to an elastic restoring force of a rubber dome 18 may sometimes be referred to as an upward direction.

Figure 7:
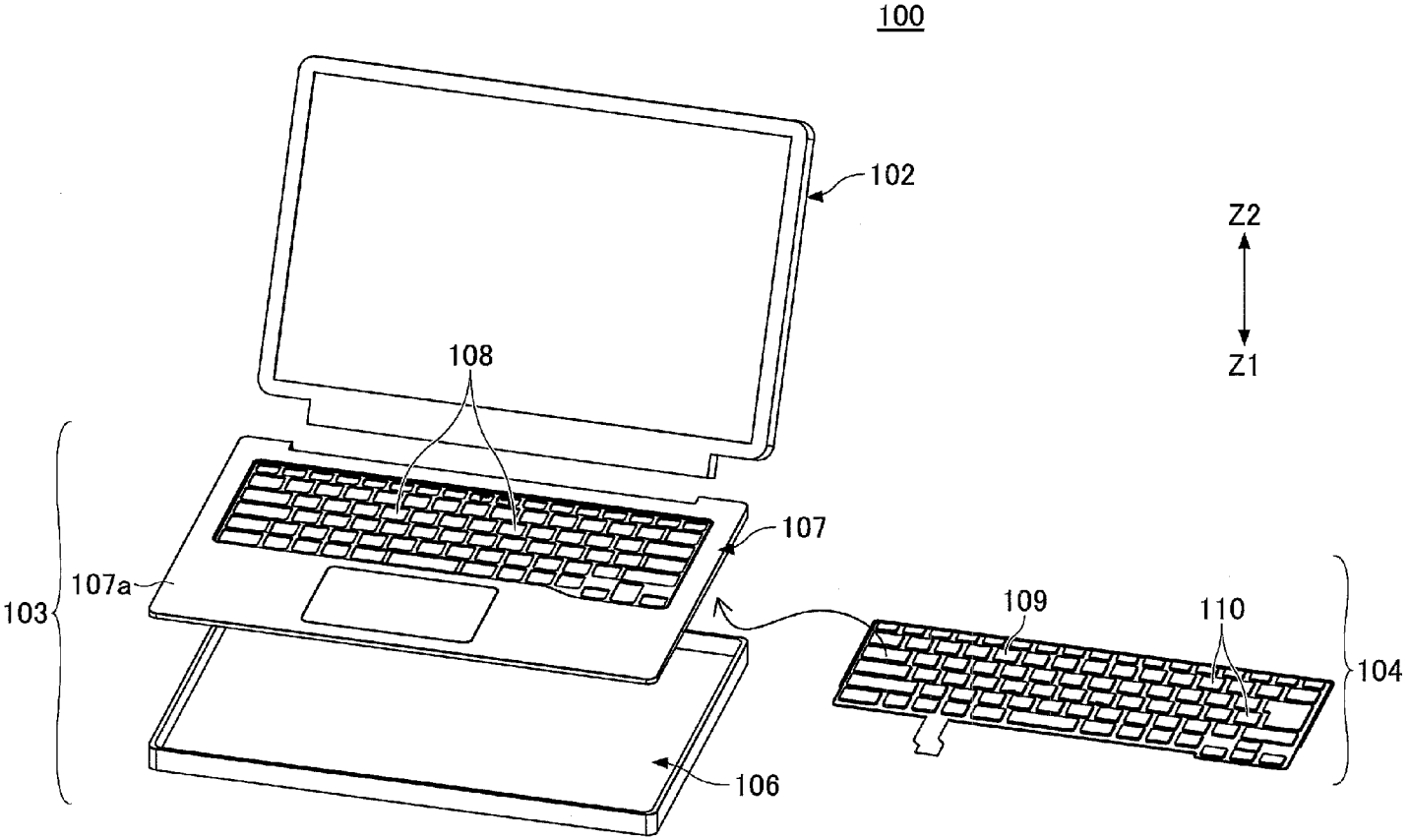
FIG. 7 is an exploded view of a notebook personal computer having a keyboard apparatus serving as a comparative example.
Figure 8:
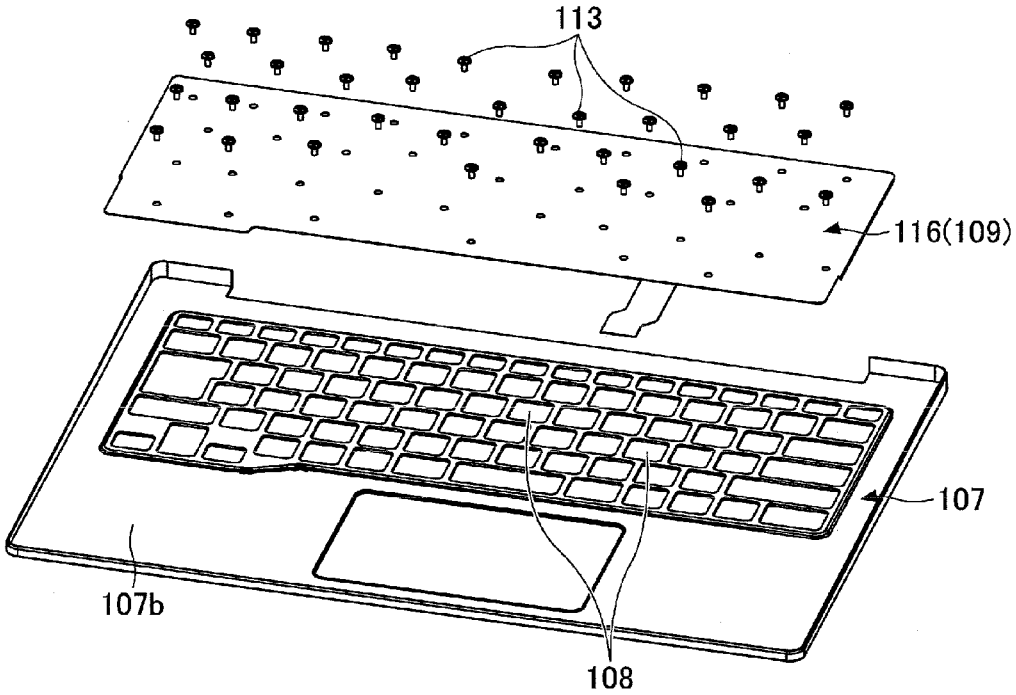
FIG. 8 is an exploded view of an upper cover and a key-switch structure as viewed from a back side thereof.
Figure 9:
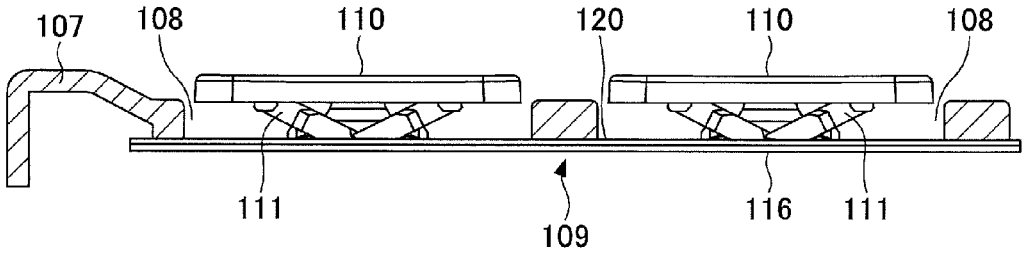
FIG. 9 is a partial cross-sectional view of the upper cover and the key-switch structure.

Before describing a keyboard apparatus 4 of an embodiment, a description will be first given of a keyboard apparatus serving as a comparative example. FIG. 7 through FIG. 9 illustrate a notebook personal computer 100 equipped with a keyboard apparatus 104, which serves as an example to be compared with the keyboard apparatus 4.

The notebook personal computer 100 includes a display unit 102, a core unit 103, and the keyboard apparatus 104. The display unit 102 is disposed to be openable and closable relative to the core unit 103. The core unit 103 includes a lower cover 106 having a box shape with an opening on the top thereof, and further includes an upper cover 107 to cover the opening of the lower cover 106.

The keyboard apparatus 104 includes the upper cover 107 and a key-switch structure 109. The upper cover 107 has a plurality of keycap holes 108 corresponding to a plurality of keycaps 110 of the key-switch structure 109.

The key-switch structure 109 includes the keycaps 110, actuators 111, a membrane switch 120, and a support panel 116. The actuators 111 enable the keycaps 110 to move down and up (i.e., in the Z1 direction and the Z2 direction) relative to the membrane switches 120.

The membrane switch 120 has a sheet shape in which a plurality of contact points are formed. The keycaps 110 and the actuators 111 are arranged at the positions of the contact points formed in the membrane switch 120.

An operator presses down a keycap 110 to cause the contact point corresponding to this keycap 110 to be electrically turned on. Releasing the keycap 110 causes the keycap 110 to be returned to its original position by the actuator 111.

The support panel 116 that is a plate made of metal such as aluminum is disposed on the back side of the membrane switch 120. The support panel 116 serves to support the membrane switch 120 having a sheet shape. With the support panel 116 being provided, the operator's operation to press the keycaps 10 does not cause the membrane switch 120 to be deformed, thereby securing satisfactory keying operations.

The key-switch structure 109 having the configuration described above is secured to a back face 107*b* of the upper cover 107 by use of screws 113 as illustrated in FIG. 8. With the key-switch structure 109 secured to the back face 107*b* of the upper cover 107, the keycaps 110 are inserted into the keycap holes 108 of the upper cover 107, so that each of the keycaps 110 partly projects from a surface 107*a* of the upper cover 107.

The keyboard apparatus 104 described above has a configuration in which the upper cover 107 and the key-switch structure 109 situated on the back face 107*b* thereof are stacked one over another, so that the whole structure of the upper cover 107 and the key-switch structure 109 has a substantial thickness. Further, the use of the metal support panel 116 causes the keyboard apparatus 104 to have a substantial weight, which prevents weight reduction from being achieved for the notebook personal computer 100. Moreover, the use of the screws 113 to secure the key-switch structure 109 to the upper cover 107 entails an increase in the number of components and cumbersome assembling.

In the following, a description will be given of the keyboard apparatus 4 of the embodiment. FIG. 1 is an exploded view of a notebook personal computer 1 having the keyboard apparatus 4 according to the embodiment.

The notebook personal computer 1 includes a display unit 2, a core unit 3, and the keyboard apparatus 4. The display unit 2 has a display device such as a liquid crystal display device. The display unit 2 is disposed to be openable and closable relative to the core unit 3.

The core unit 3 includes a lower cover 6 and an upper cover 7. The lower cover 6 has a box shape with an opening at the top thereof. The upper cover 7 is attached to the lower cover 6 to cover the opening of the lower cover 6.

The provision of the upper cover 7 on the lower cover 6 creates a space inside the core unit 3, in which various circuit components constituting the notebook personal computer 1 such as a hard drive, a battery, etc., are installed.

The keyboard apparatus 4 includes the upper cover 7 and a key-switch structure 9. The upper cover 7 serves as part of the core unit 3 of the notebook personal computer 1, and also serves as part of the keyboard panel of the keyboard apparatus 4.

As illustrated in FIG. 1 and also in FIG. 2 through FIG. 5, the key-switch structure 9 includes keycaps 10, actuators 11, and a membrane switch 20.

Figure 2:
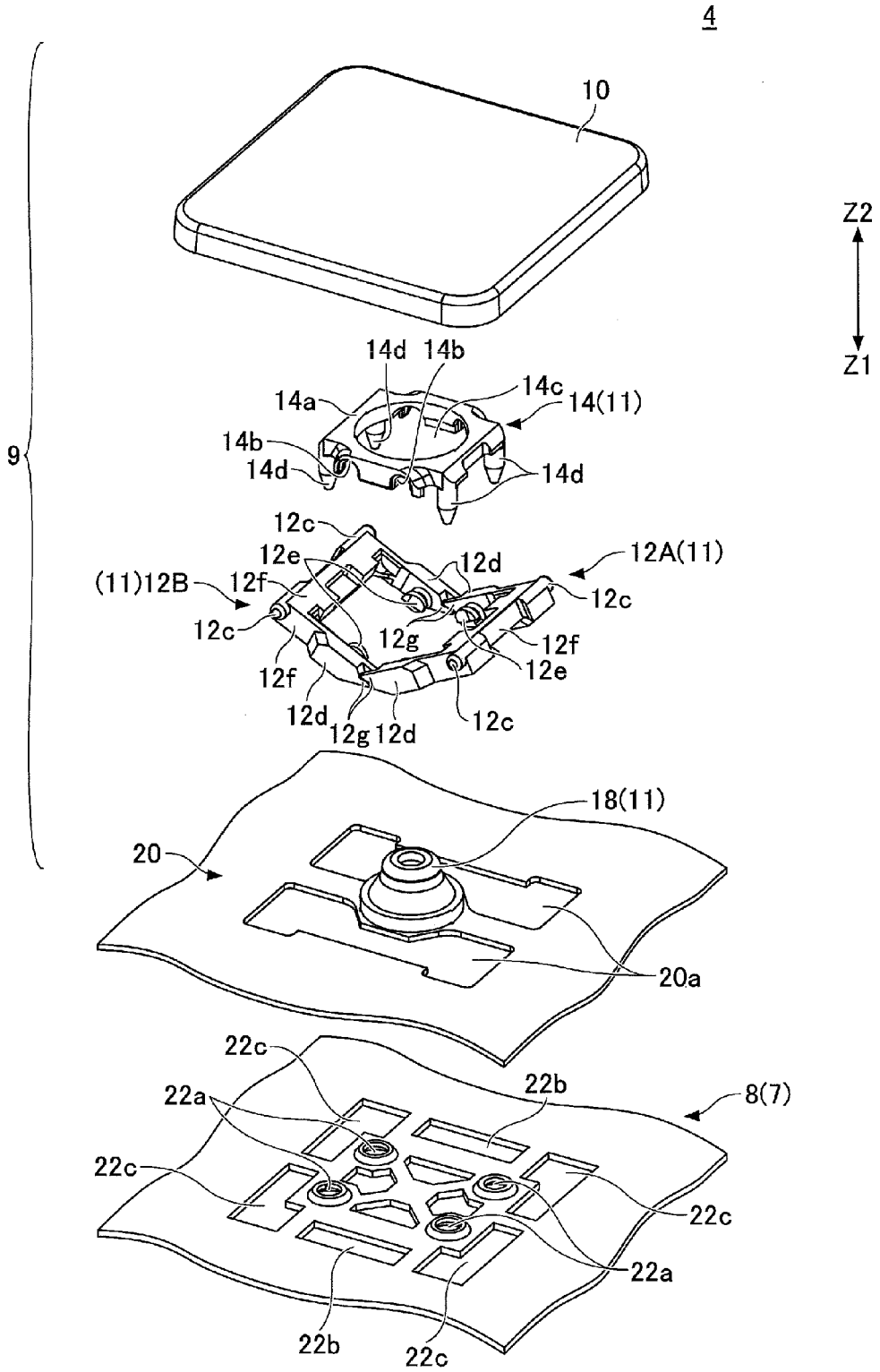
FIG. 2 is an exploded, enlarged view of an upper cover, a keycap, an actuator, and a membrane switch.
Figure 3:
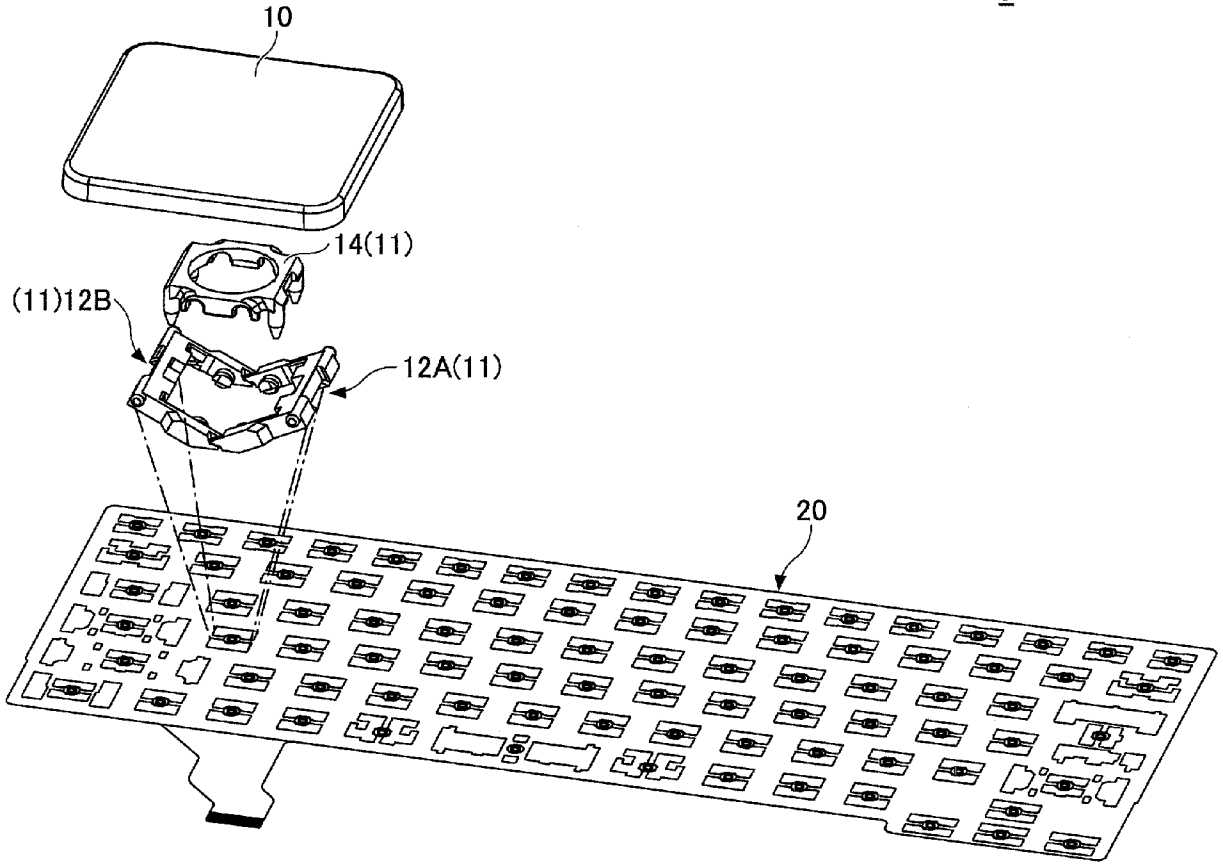
FIG. 3 is an exploded view of a keycap, an actuator, and the membrane switch.
Figure 4:
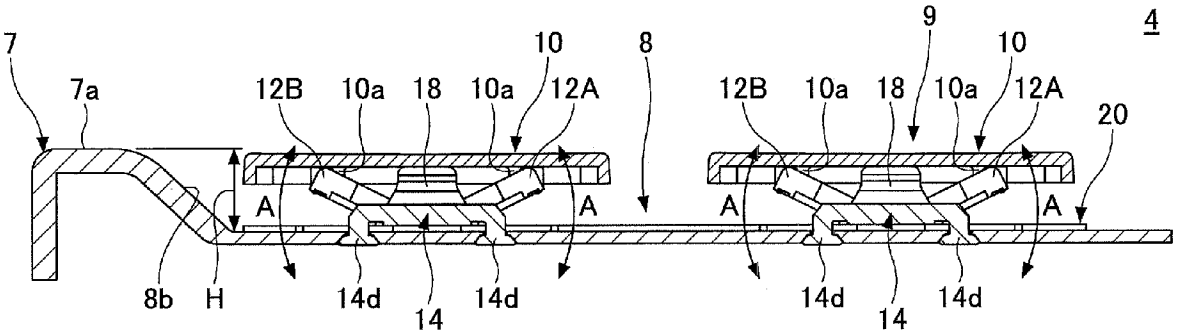
FIG. 4 is a partial cross-sectional view of a mount part.
Figure 5:
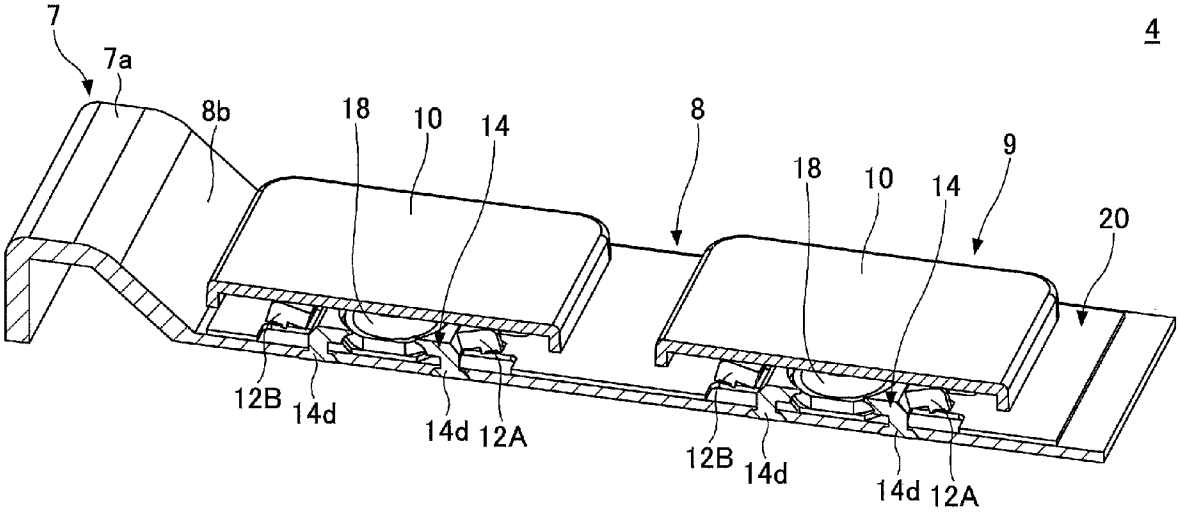
FIG. 5 is a partial perspective view of the mount part with an illustration of a cross-section thereof.

FIG. 2 is an exploded, enlarged view of the upper cover 7, a keycap 10, an actuator 11, and the membrane switch 20. FIG. 3 is an exploded view of a keycap 10, an actuator 11, and the membrane switch 20. FIG. 4 is a cross-sectional view of part of a mount part 8. FIG. 5 is a perspective view of part of the mount part 8 with an illustration of a cross-section thereof.

The keycaps 10 are selectively pressed by an operator. Each of the keycaps 10 has hooks 10*a* extending downwardly from the lower surface thereof as illustrated in FIG. 4.

The actuators 11 include a gear link 12A, a gear link 12B, a housing 14, and a rubber dome 18.

The gear link 12A and the gear link 12B have the same structure, and are disposed in rotational symmetry. Since the gear link 12A and the gear link 12B have the same structure, the structure of the gear links 12A and 12B will be described collectively in the following.

Each of the gear links 12A and 12B has a U shape that is made by two arms 12*d* and a link member 12*f* which connects between ends of the two arms 12*d*. Each of the arms 12*d* has an engagement part 12*g* at the other end thereof. The gear links 12A and 12B are linked to each other as the engagement parts 12*g* engage with each other. In the linked state, the gear links 12A and 12B operate in conjunction with each other.

The link member 12*f*, which is disposed at the ends of the arms 12*d* opposite from where the engagement parts 12*g* are formed, has axes 12*c* at the ends thereof. The keycap 10 and the gear links 12A and 12B are linked together as the axes 12*c* and the hooks 10*a* are engaged with each other.

Each of the arms 12*d* has an axis 12*e* formed on the inside face thereof in the vicinity of the engagement part 12*g*. The axis 12*e* is received by the housing 14.

The housing 14 is a molded resin piece, and includes a core part 14*a*, bearings 14*b*, a hole 14*c*, and legs 14*d*. The core part 14*a* has a rectangular shape as viewed from above, and has the hole 14*c* at the center thereof. The bearings 14*b* are formed at the bottom of the four sides of the core part 14*a* and positioned to come in contact with the axes 12*e*, respectively. The axes 12*e* formed on the gear links 12A and 12B are received in the bearings 14*b* of the housing 14, respectively.

The legs 14*d* extend downwardly from the four corners of the core part 14*a*, respectively. The legs 14*d* serve to secure the housing 14 to the upper cover 7.

The rubber dome 18 is made of elastic material such as silicon rubber. The rubber dome 18 has an upper tip thereof placed in contact with the keycap 10, and has a bottom part thereof placed in contact with the membrane switch 20.

The membrane switch 20 includes a plurality of contact points each serving as a switch. The rubber domes 18 are disposed on the respective contact points of the membrane switch 20. With this arrangement, the rubber domes 18 are situated between the respective keycaps 10 and the respective contact points of the membrane switch 20.

The keycap 10, the gear links 12A and 12B, the housing 14, and the rubber dome 18 are disposed together at each of the contact points, as is understood by the illustration in FIG. 3.

The membrane switch 20 has openings 20*a* on both sides of the rubber dome 18. The openings 20*a* have a size such that the engagement parts 12*g* of the gear links 12A and 12B and the legs 14*d* of the housing 14 are able to pass through the openings 20*a*.

The key-switch structure 9 having the configuration described above is placed on the upper cover 7 that is part of the housing of the notebook personal computer 1 as illustrated in FIG. 1.

The upper cover 7 is a metal panel, and has the mount part 8 that is formed seamlessly and integrally with the upper cover 7 at the area where the key-switch structure 9 is mounted. The material of the upper cover 7 is preferably made of aluminum or magnesium alloy from the viewpoint of light weight.

The mount part 8 is a recess having a lower surface relative to an upper face 7*a* of the upper cover 7. The mount part 8 may be formed together with the upper cover 7 by use of plastic working (e.g., press working) at the time of forming the upper cover 7.

The processing of the mount part 8 is not limited to the use of plastic working, and may be performed by use of other types of processing such as cutting, drilling, etc. The material of the upper cover 7 may alternatively be resin material such as carbon-fiber reinforced resin or the like. In the case of resin material being used, the mount part 8 may be formed together with the upper cover 7 by use of a mold at the time of forming the upper cover 7.

The mount part 8 has a flat surface. As illustrated in FIG. 2, the mount part 8 has insertion holes 22*a*, openings 22*b*, and back-light holes 22*c* formed therein. As illustrated in FIG. 4, the perimeter of the mount part 8 has a sloped face 8*b* connecting between the upper face 7*a* of the upper cover 7 and the mount part 8. The face connecting between the upper face 7*a* and the mount part 8 may not be limited to the sloped face 8*b*, and may alternatively have another face structure such as a vertical face or steps.

The insertion holes 22*a* serve as holes to which the legs 14*d* of the housing 14 are inserted. The insertion holes 22*a* are positioned to receive the housing 14 that is placed.

The openings 22*b* and the back-light holes 22*c* are arranged around the area where the insertion holes 22*a* are situated. The insertion holes 22*a* and the back-light holes 22*c* are positioned to face the openings 20*a* of the membrane switch 20.

In order to assemble the keyboard apparatus 4, the membrane switch 20 is first mounted on the mount part 8 of the upper cover 7. In the present embodiment, the membrane switch 20 is directly disposed on the upper face of the mount part 8 of the upper cover 7.

When the membrane switch 20 is placed on the mount part 8, the membrane switch 20 is aligned such that each rubber dome 18 is positioned at the center of the four corresponding insertion holes 22*a* and such that the openings 22*b* and the back-light holes 22*c* are positioned to face the openings 20*a*.

Subsequently, the axes 12*e* of the gear links 12A and 12B that are connected to each other through the engagement of the engagement parts 12*g* are inserted into the bearings 14*b* of the housing 14. After the axes 12*e* are inserted into the bearings 14*b*, the legs 14*d* of the housing 14 are inserted into the insertion holes 22*a* of the mount part 8.

Upon the legs 14*d* being inserted into the insertion holes 22*a*, the tips of the legs 14*d* project from the back face of the mount part 8. The portions of the legs 14*d* projecting from the back face of the mount part 8 are thermally deformed by a heating tool for securement purposes. FIG. 4 and FIG. 5 provide illustrations in which the portions of the legs 14*d* projecting from the back face of the mount part 8 are thermally deformed for securement purposes.

With the legs 14*d* being thermally deformed at the back face of the mount part 8, the housing 14 is fixedly mounted to the mount part 8. Fixedly mounting the housing 14 to the mount part 8 causes the axes 12*e* to be placed between the bearings 14*b* and the mount part 8. The axes 12*e* are thus prevented from disengaging from the bearings 14*b* once the housing 14 is fixedly mounted to the mount part 8.

The engagement parts 12*g* are positioned to be inside the openings 22*b* of the mount part 8 when the gear links 12A and 12B are placed on the mount part 8. With this arrangement, the rotational movement of the gear links 12A and 12B around the axes 12*e* does not cause the engagement parts 12*g* situated below the axes 12*e* to come in contact with the mount part 8 to interfere with the rotational movement of the gear links 12A and 12B. It may be noted that arrows A in FIG. 4 indicate directions in which the gear links 12A and 12B rotate.

After the gear links 12A and 12B, the housing 14, and the membrane switch 20 are secured to the mount part 8, the hooks 10*a* are engaged with the axes 12*c* to mount the keycap 10 to the gear links 12A and 12B. Upon the housing 14 being fixedly mounted to the mount part 8, the rubber dome 18 projects upwardly through the hole 14*c* of the housing 14. With this arrangement, the mounting of the keycap 10 to the gear links 12A and 12B causes the center of the lower face of the keycap 10 to come in contact with the upper end of the rubber dome 18.

When the keycap 10 is not pressed down (not being operated) as illustrated in FIG. 4 and FIG. 5, the axes 12*c* coupled to the keycap 10 are situated at the highest possible elevation due to the force of the rubber dome 18 upwardly urging the keycap 10. At the time of no pressing operation, the rubber dome 18 does not press the contact point of the membrane switch 20, so that the contact point is kept in the off state.

Pressing down the keycap 10 with a user finger or the like (at the time of a pressing operation) causes the lower face of the keycap 10 to press down the rubber dome 18. In response, the gear links 12A and 12B exhibit a rotational movement such that the height of their axes 12*c* are lowered. Further, the rubber dome 18 elastically deforms upon being pressed by the keycap 10, thereby pressing the contact point of the membrane switch 20. The contact point is placed in the on state as the keycap 10 presses the contact point of the membrane switch 20 through the rubber dome 18.

As the finger disengages from the keycap 10, the elastic restoring force of the rubber dome 18 pushes up the keycap 10, resulting in the contact point being in the off state. In conjunction with the upward movement of the keycap 10, the gear links 12A and 12B return to their original position as observed at the time of no pressing operation.

According to the present embodiment, the key-switch structure 9 including the keycaps 10, the gear links 12A and 12B, the housings 14, and the membrane switch 20 is placed on the mount part 8 that is formed with the upper cover 7 to form a seamless, continuous whole. With this configuration, a pressing force applied to the keycap 10 is ultimately applied to the mount part 8.

The upper cover 7 including the mount part serves as part of the housing of the notebook personal computer 1. Especially when the upper cover 7 is made of metal, the upper cover 7 has a satisfactory structural strength and stiffness. The pressing force to press down the keycap 10 is received by the mount part 8 having a satisfactory structural strength.

The fact that the mount part 8 receives the pressing force for pressing down the keycap 10 allows the mount part 8 to serve as a reinforcement for the key-switch structure 9. Even when the keycap 10 is pressed down hard, no deformation occurs with respect to the mount part 8, thereby providing satisfactory key feeling.

According to the present embodiment, the reinforcement of the key-switch structure 9 is achieved without providing a support panel, thereby enabling the weight and thickness reduction of the keyboard apparatus 4. Further, the number of components is reduced compared with the configuration that uses a support panel, thereby enabling cost reduction with respect to the keyboard apparatus 4.

It may be conceivable to dispose a support panel on the mount part 8 to reinforce the key-switch structure 9. This structure, however, necessitates an increase of the depth (indicated as "H" in FIG. 4) of the mount part 8 by an increment equal to the thickness of the support panel. Alternatively, reducing the depth H by disposing the support panel ends up reducing a stroke length of the keycaps 10 by a reduction equal to the thickness of the support panel. This may end up undermining key feeling. Because of this, it is preferable to place the key-switch structure 9 directly on the mount part 8 as in the present embodiment.

Figure 6:
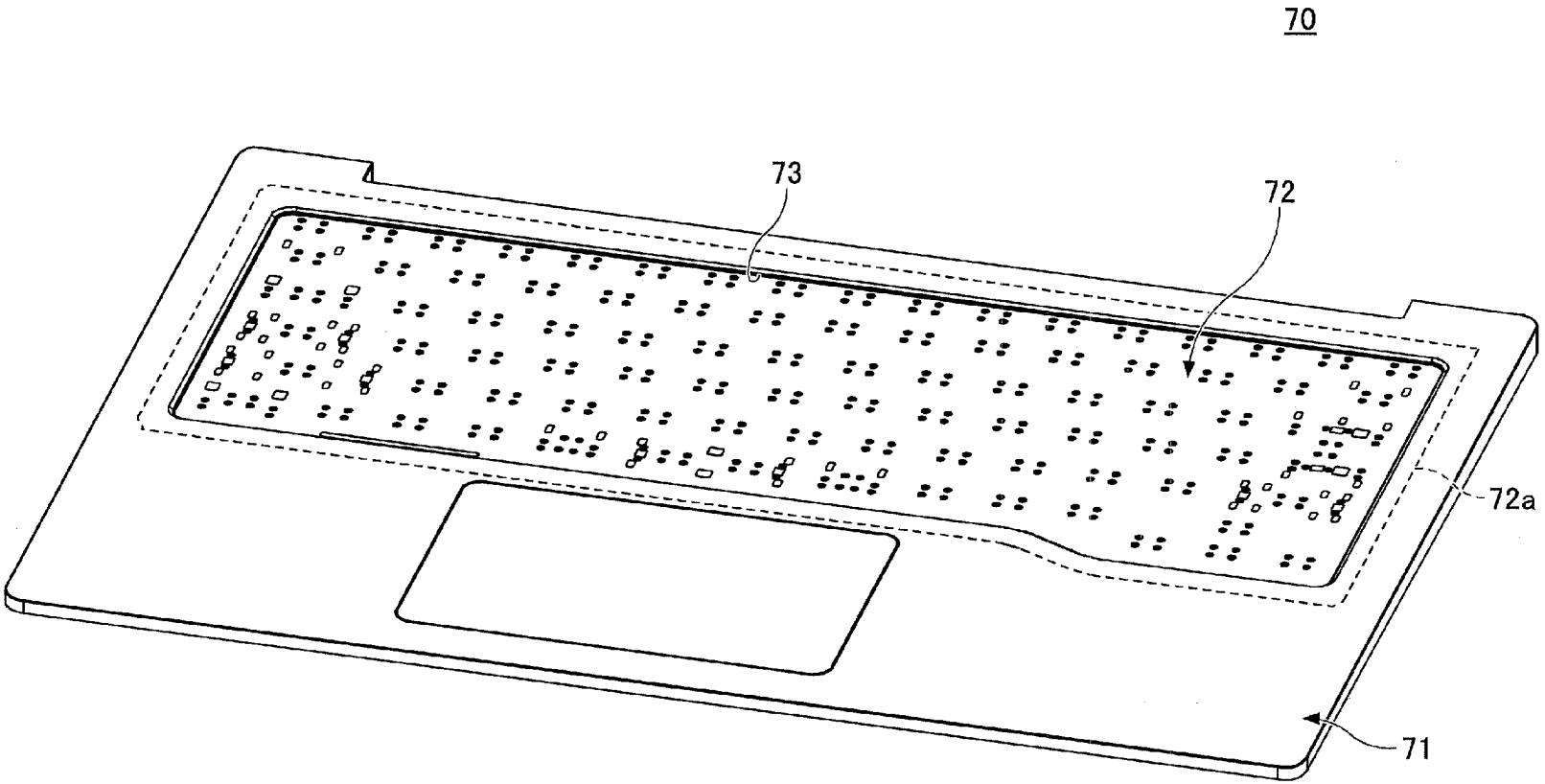
FIG. 6 is a perspective view of a variation of an upper cover of a keyboard apparatus.

FIG. 6 is a drawing illustrating a variation of the keyboard apparatus. FIG. 6 only illustrates an upper cover 70 constituting part of a keyboard apparatus. In the following description, the same or corresponding elements as those of FIGS. 1 through 5 are referred to by the same numerals.

The keyboard apparatus 4 illustrated in FIG. 1 through FIG. 5 has the mount part 8 that is formed seamlessly and integrally with the upper cover 7. In contrast, the upper cover 70 of this variation includes a cover 71 and a mount plate 72 that are each distinct, individual parts.

The cover 71 is made of resin, and has an opening 73 at the center thereof. The mount plate 72 is made of metal, and serves to reinforce the key-switch structure 9. The mount plate 72 is attached to the cover 71 in such a manner as to seal the opening 73. The mount plate 72 is formed integrally with the cover 71 by use of insert molding.

The keyboard apparatus using the upper cover 70 according to this variation has the mount plate 72 having a satisfactory structural strength and stiffness. Even in the case of the keycap 10 being pressed down hard, the mount part 8 does not exhibit deformation, thereby enabling the provision of satisfactory key feeling.

In this variation, the mount plate 72 is disposed to seal the opening 73 of the cover 71. Such a configuration enables the weight and thickness reduction of the keyboard apparatus compared with the configuration in which a support panel is secured by screws to the back face of an upper cover having holes corresponding to respective keycaps as in the comparative example.

Further, the present invention is not limited to these embodiments, but various variations and modifications may be made without departing from the scope of the present invention.

The present application is based on Japanese priority application No. 2015-017585 filed on Jan. 30, 2015, with the Japanese Patent Office, the entire contents of which are hereby incorporated by reference.

What is claimed is:

1. A keyboard apparatus of an electronic apparatus, comprising:

a key-switch structure including a membrane switch having contact points, keycaps for operating the contact points of the membrane switch, and actuators configured to urge the keycaps upwardly upon the keycaps being pressed down; and an upper cover configured to be part of a housing case of the electronic apparatus and having a mount part that is a flat surface part of the housing case of the electronic apparatus, the mount part supporting the key-switch structure that is placed on an upper surface of the mount part, wherein the mount part is formed integrally with the upper cover, wherein the mount part and the upper cover are seamlessly made of a same material, and wherein the actuators include respective key-switch housings for movably fastening the actuators urging the keycaps to the mount part that is the flat surface part of the housing case of the electronic apparatus, and the key-switch housings are in a close fitting engagement with holes formed in the flat surface part of the housing case of the electronic apparatus so as to be directly fastened to the flat surface part of the housing case of the electronic apparatus.

2. The keyboard apparatus as claimed in claim 1, wherein the mount part is a recess formed on the upper cover.

3. The keyboard apparatus as claimed in claim 1, wherein the membrane switch is disposed directly on an upper surface of the mount part.

4. The keyboard apparatus as claimed in claim 1, wherein the upper cover is formed integrally with the housing case of the electronic apparatus.

5. An upper cover for a keyboard of an electronic apparatus, comprising a mount part configured to support, on an upper surface thereof, a membrane switch having contact points, keycaps for operating the contact points, and actuators configured to urge the keycaps upwardly, the mount part being a flat surface part of a housing case of the electronic apparatus, wherein the mount part is formed integrally with the upper cover, and the mount part and the upper cover are seamlessly made of a same material, and wherein the actuators include respective key-switch housings for movably fastening the actuators urging the keycaps to the mount part that is the flat surface part of the housing case of the electronic apparatus, and the key-switch housings are in a close fitting engagement with holes formed in the flat surface part of the housing case of the electronic apparatus so as to be directly fastened to the flat surface part of the housing case of the electronic apparatus.

6. The keyboard apparatus as claimed in claim 1, wherein the same material is one of aluminum, a magnesium alloy, and a carbon-fiber reinforced resin.

* * * * *